United States Patent [19]

Tüns

[11] 4,083,388

[45] Apr. 11, 1978

[54] FILL METERING SYSTEM

[75] Inventor: Joseph Tüns, Dachsen, Switzerland

[73] Assignee: S I G Schweizerische Industrie-Gesellschaft, Neuhausen am Rheinfall, Switzerland

[21] Appl. No.: 753,425

[22] Filed: Dec. 22, 1976

[30] Foreign Application Priority Data

Dec. 23, 1975 Switzerland ..... 16753/75

[51] Int. Cl.[2] ..... B65B 43/58

[52] U.S. Cl. ..... 141/172; 141/392

[58] Field of Search ..... 193/3, 22, 32; 141/257, 141/253, 275, 281, 276, 277, 278, 129–191, 256, 392, 286, 301, 374; 302/50

[56] References Cited

FOREIGN PATENT DOCUMENTS

| | | | |
|---|---|---|---|
| 269,103 | 6/1912 | Germany | 141/257 |
| 1,435,444 | 5/1976 | United Kingdom | 302/50 |

*Primary Examiner*—Houston S. Bell

*Attorney, Agent, or Firm*—Spencer & Kaye

[57] ABSTRACT

Fill metering apparatus for introducing a measured quantity of particulate material into each of a succession of containers and including a downwardly tapering material discharge member presenting an outlet opening which is inclined to the vertical, a lifting device for lifting a container to be filled to a level at which the discharge member projects into the container, and a control unit connected for permitting material to flow through the outlet opening only after a container has been brought under the discharge member and lifted to such level.

6 Claims, 2 Drawing Figures

FILL METERING SYSTEM

BACKGROUND OF THE INVENTION

The present invention relates to a fill metering system for powdery or granular fill material of the type composed of metering devices connected ahead of shut-off, or flow blocking means and in which containers to be filled are automatically and successively brought underneath the shut-off means and receive a measured quantity of the fill material during the time the shut-off means are open.

Known devices of this type have the drawback that during the filling of a container, the air displaced out of the container by the fill material carries along a rather large quantity of the fill material so that, in spite of the provision of an extraction hood, the fill station will very soon be completely enveloped in dust and must be cleaned rather frequently.

Detailed studies have shown that this is mainly the result of the fact that during filling of a container, the fill material flows vertically downwardly while the air in the container whirls away toward all sides. This air turbulence is, generally, even augmented by the fact that the shut-off means are usually constituted by two pushers which are guided in opposite directions and which open and close above the container in a scissors-like manner. The operating rhythm of such a device cannot, in practice, be increased to more than 100 fills per minute because at higher rates the air turbulence would prevent accurate filling of the containers.

SUMMARY OF THE INVENTION

It is therefore an object of the present invention to eliminate the above-noted drawbacks of known fill metering systems.

A further object of the invention is to significantly increase the rate at which containers can be filled.

These and other objects are achieved, according to the invention in a fill metering system for filling a succession of containers with dry, particulate material and including a material supply unit composed of a metering device for delivering a measured quantity of material to each container, and a shut-off member for selectively blocking flow of material between filling operations, a plurality of containers being moved in turn under the shut-off member to receive a respective measured quantity of material, by further providing the material supply unit with a downwardly tapering material discharge member presenting a material outlet opening having a central axis inclined to the vertical; mounting the shut-off member for selectively closing the outlet opening; and further providing the system with a device for lifting a container located under the discharge member to a level at which the discharge member projects into the container, and a control device operatively associated with the lifting device and the shut-off member for opening the shut-off member only when a container has been placed under the discharge member and has been lifted to such level. It has been found that this arrangement causes the air displaced from the container to be guided out of the container in an extraordinarily effective manner, with the practical result that there is a great reduction in the formation of dust, and a significant increase in the operating rhythm becomes possible.

DESCRIPTION OF THE PREFERRED EMBODIMENTS

Figures 1, 2:
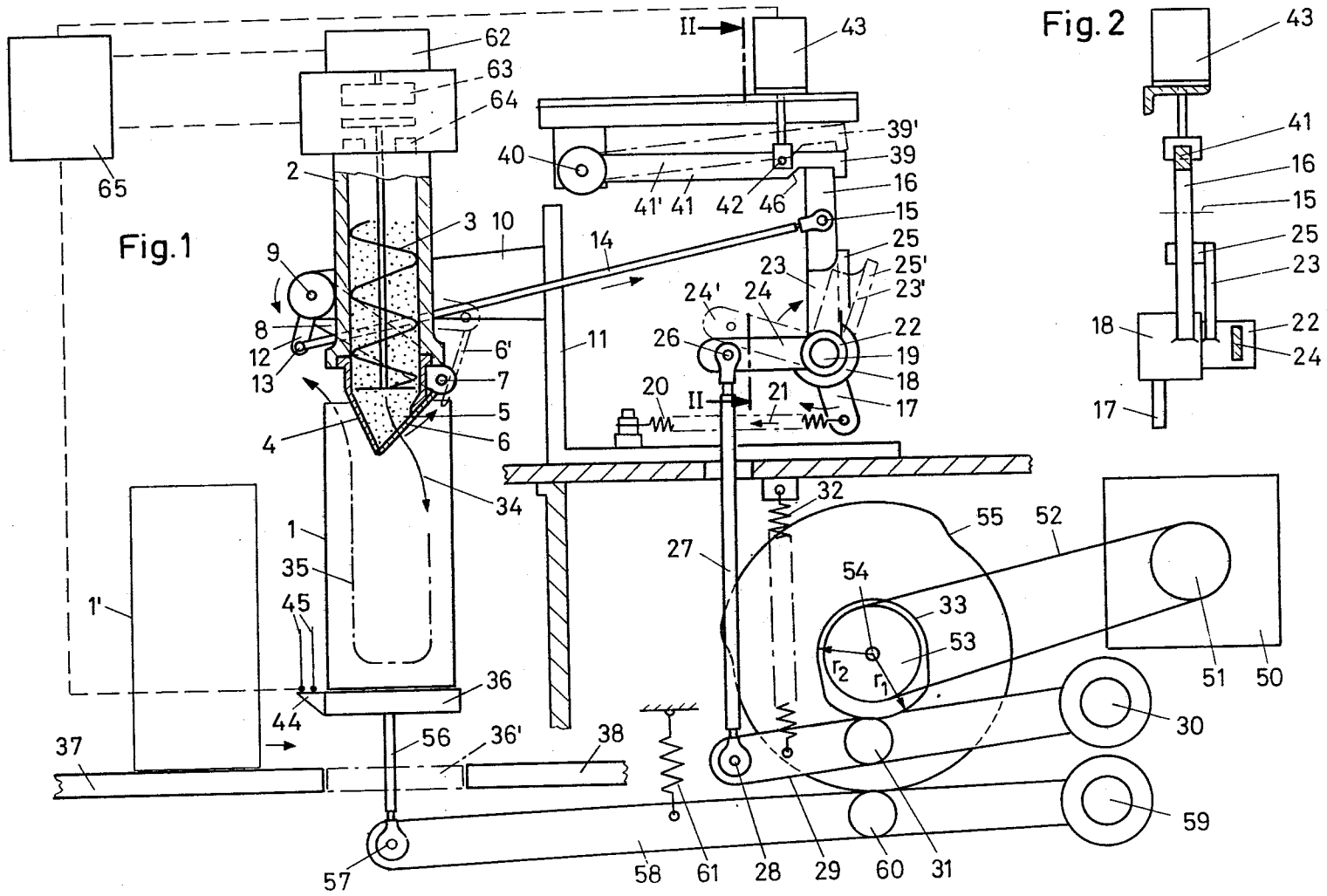
FIG. 1 is an elevational, cross-sectional view of a fill metering system according to a preferred embodiment of the invention.
FIG. 2 is a cross-sectional view along line II—II of FIG. 1.

The apparatus illustrated in FIGS. 1 and 2 serves to meter the filling of a dry particulate, i.e. granular or powdery, material, for example flour, into packaging containers 1, e.g. bags, boxes or the like. The fill material flows downwardly intermittently through a vertical fill tube 2 of circular cross section, i.e. whenever a metering worm 3 disposed inside tube 2 is rotated through an angle $n$. 360° where $n$ may be a whole number or a fraction. The value of $n$ is given progressively higher values for progressively larger container sizes.

Tube 1 is provided at the bottom with a conically tapered discharge member 4 provided with a lateral opening, or orifice, 5 that can be closed by a planar flap 6. Discharge member 4 has the form of a circular cone having a downwardly directed apex. The cone is cut off along a plane which is inclined to the horizontal to define the discharge opening 5. The flap 6 is formed to cover the opening 5 and is at least large enough to be coextensive with the outline of the opening 5.

Flap 6 is fixed to the lower end 7 of an inclined arm 8 whose upper end is pivotally mounted on a horizontal shaft 9. Shaft 9 is mounted in a bracket 10 which is fastened to a support 11 fixed to the machine frame.

A short arm 12 is also fastened to shaft 9 to pivot with arm 8 and one end of a rod 14 (not shown in FIG. 2) is articulated to arm 12 at a joint 13. The other end of rod 14 is articulated, by a joint 15, to the upper arm 16 of a two-arm lever 16, 17 whose fulcrum 18 is pivotally mounted on a shaft 19 fixed to the machine frame. The lower arm 17 of lever 16, 17 is tensioned in the direction of arrow 21 by a tension spring 20 connected between the free end of arm 17 and the machine frame. The fulcrum 22 of an angle lever 23, 24 is also pivotally mounted on shaft 19. Arm 23 of lever 23, 24, which is vertical in the position shown in solid lines, has a detent tongue 25 at its upper end which passes behind lever arm 16 and thus prevents, in its above-mentioned vertical position, lever 16, 17 from being pivoted clockwise (FIG. 1) under the influence of the bias force applied by spring 20. The solid-line position of lever 23, 24 is thus its blocking position.

The lever arm 24 which in the blocking position of lever 23, 24 is horizontal, is connected at a joint 26 to the upper end of a rod 27 whose lower end is articulated at a joint 28 to the free end of a lever 29. Lever 29 is pivotally mounted on a shaft 30 fixed to the machine frame and is provided at an intermediate point along its length with a rotatably mounted sensing roller 31 which is kept in contact with the periphery of a cam disc 33 by a tension spring 32 connected between lever 29 and the machine frame.

If, during rotation of cam disc 33, the sensing roller 31 moves from the small peripheral section with the larger radius $r_1$ to the large section with the smaller radius $r_2$, lever 29 follows the pull of spring 32 so that rod 27 pivots the lever 23, 24 into the release position 23', 24' shown in dot-dash lines. Now, lever 16, 17 can follow the pull of its bias spring 20 so that arms 8 and 12, which are disposed on shaft 9, can be pivoted counterclockwise and thus arm 8 moves flap 6 into the open position 6'. These movements are illustrated by associated arrows.

Now the fill material is delivered by rotation of worm 3 and flows in the direction of arrow 34 out of the side of discharge member 4, which projects into container 1, and thus displaces the air in container 1 so that it escapes along the other side of discharge member 4, i.e. in the direction of arrow 35. The metering worm 3 is controlled in synchronism with cam disc 33 so that it rotates as long as sensing roller 31 lies on the section with the smaller radius $r_2$, when flap 6 is open, and does not rotate if sensing roller 31 lies against the section with the larger radius $r_1$, when flap 6 is closed.

The container 1 at the filling location rests on a plunger 36 which lifts it into the illustrated filling position. The containers 1' upstream of the filling location are pushed in succession from an intake path 37 onto plunger 36 by means of pushers (not shown), for example pushers which are fastened to an intermittently advancing chain whenever the container is in its lowermost position 36'. After lifting and filling of container 1, plunger 36 is lowered again and the filled container 1 is transported away on an exit path 38.

In order to dependably prevent flap 6 from opening before container 1 has reached the filling position in which the discharge member 4 protrudes sufficiently far into the container, there is provided a blocking catch 39 which also coacts with lever 16, 17 in addition to the detent tongue 25 controlled by cam disc 33. Blocking catch 39 is disposed at the free end of a lever 41 which is pivotally attached to a stationary support at a pivot shaft 40 and is articulated at a joint 42 to the armature of an electromagnet 43 which is fixed to the machine frame. When plunger 36 is in the fill position, a conductive contact 44 attached thereto closes the circuit 45 for supplying current to the coil of electromagnet 43 so that the armature is pulled up and pivots lever 41 into the release position 41'. The plunger 36 can also actuate the circuit 45 in some other manner, for example via a magnetic proximity switch.

Only after detent tongue 25 and blocking catch 39 are in their released positions 25' and 39', respectively, can flap 6 be opened by the action of spring 20. When sensing roller 31 returns to the illustrated position on cam disc 33, spring 20 is tensioned and flap 6 is closed so that the free end of lever arm 16 returns to its starting position below lever 41.

The illustrated apparatus is able to operate perfectly even at a fast operating rhythm of, for example, 150 fills per minute, and only very little flour or the like is carried along by the stream of air escaping from container 1. Advisably this stream of air can also be captured in a suction hood (not shown).

Instead of worm 3, a drum, for example, or some other known metering device can be used to meter out the fill material so that fill tube 2 is loaded with measured quantities of the fill material.

It should be emphasized that the control device 7–33 serving to actuate flap 6 operates significantly more accurately than the prior art means usually employed to actuate the cut-off means, i.e. pneumatic cylinders controlled by magnetic valves which operate too imprecisely at fast speeds.

For synchronizing the movement of rotating worm 3, and plunger 36 with cam disc 33, FIG. 1, further shows a driving motor 50 with a driving pulley 51 and a driven pulley 53 on a driving shaft 54 on which cam disc 33 and a further cam disc 55 are rigidly mounted. The power transmission between driving pulley 51 and driving pulley 53 is achieved by a driving belt 52. Actuation of plunger 36 is made by means of a rod 56 whose lower end is articulated at a joint 57 to the free end of a lever 58. This lever 58 is pivotally mounted on a shaft 59, fixed to the machine frame and is provided at an intermediate point along its length with a rotatably mounted sensing roller 60, which is kept in contact with the periphery of the further cam disc 55 by a tension spring 61 connected between lever 58 and a point on the machine frame.

For actuating worm 3 there is a second driving motor 62 which by means of a clutch 63 and a break 64 drives the shaft of the worm 3. For controlling electromagnet 43, motor 62, clutch 63 and break 64 there is provided a controller 65 which in its turn is actuated by circuit 45 and conductive contact 44. The controlling leads between circuit 45, controller 65, and controlled means are shown by broken lines for distinguishing purpose between such leads and mechanical parts.

Rotating cam discs 33 and 55 operate levers 29 and 58. By means of the rods 27 and 56 plunger 36 and control device 7–33 are operated in perfect synchronism and further plunger 36 operates by means of its contact 44, controller 65 so that the motor 62 rotates worm 3 only when plunger 36 is in its lifted position and flap 6 is actuated.

It will be understood that the above description of the present invention is susceptible to various modifications, changes and adaptations, and the same are intended to be comprehended within the meaning and range of equivalents of the appended claims.

What is claimed is:

1. In a fill metering system for filling a succession of containers with dry, particulate material and including a material supply unit composed of a metering device for delivering a measured quantity of material to each container, and a shut-off member for selectively blocking flow of material between filling operations, a plurality of containers being moved in turn under the shut-off member to receive a respective measured quantity of material, the improvement wherein: said material supply unit further comprises a downwardly tapering material discharge member presenting a material outlet opening having a central axis inclined to the vertical; said shut-off member is mounted for selectively closing said outlet opening; and said system further comprises means for lifting a container located under said discharge member to a level at which said discharge member projects into the container with said outlet opening inclined to the container sides, and control means operatively associated with said means for lifting and said shut-off member for opening said shut-off member only when a container to be filled has been placed under said discharge member and has been lifted to such level.

2. An arrangement as defined in claim 1 wherein said shut-off member is constituted by a flap and said control means comprise: a first arm mounted to pivot about an axis and connected to said flap at a point remote from its pivot axis in a manner such that pivotal movement of said first arm moves said flap between a blocking position in which it closes said opening and an unblocking position in which it is spaced from said opening; a first lever mounted to pivot about an axis; first linkage means connecting said first arm to said first lever for causing pivotal movement of said first lever to effectuate movement of said flap between its said positions; first bias means connected to said first lever for urging said lever toward the position in which said flap is brought to its unblocking position; and detent means movable between a holding position in which it holds said first lever in a position which maintains said flap in its blocking position and a release position in which it permits said first lever to be moved by said first bias means in a manner to bring said flap to its unblocking position, and wherein said control means are arranged to control said detent means in synchronism with said metering device to move said detent means to its release position only during a time when a container to be filled is in the filling position and material is to be delivered to the container.

3. An arrangement as defined in claim 2 wherein said control means further comprise: a second lever mounted to pivot about an axis and carrying said detent means; a third lever mounted to pivot about an axis; second linkage means connected between said second and third levers for causing the pivotal movement of said third lever to control the pivotal movement of said second lever; a cam follower mounted on said third lever; a rotatable cam disc engaged by said follower and formed to move said third lever in a manner to cause movement of said second lever to move said detent means between its holding and release positions, rotation of said cam disc being synchronized with operation of said metering device.

4. An arrangement as defined in claim 3 wherein said meter device is constituted by a metering worm arranged to rotate through a predetermined angle during each time that said flap is in its unblocking position.

5. An arrangement as defined in claim 2 wherein said control means further comprise: locking means movable between a locking position in which said locking means holds said first lever in the position which maintains said flap in its blocking position and an unlocking position in which said locking means has no influence on said first lever; and operating means operatively associated with said locking means and said means for lifting to move said locking means to its unlocking position only when said lifting means is holding a container at the level at which said discharge member projects into the container.

6. An arrangement as defined in claim 5 wherein said operating means comprise an electromagnet having a coil connected to receive operating current in response to movement of said means for lifting and having a plunger connected to said locking means and moved in response to the flow of operating current through said coil.

* * * * *